US005398972A

United States Patent [19]

Todaro

[11] Patent Number: 5,398,972

[45] Date of Patent: Mar. 21, 1995

[54] FORTUNE TELLING CARD

[76] Inventor: Frank S. Todaro, 316 Edna St., East McKeesport, Pa. 15035

[21] Appl. No.: 212,360

[22] Filed: Mar. 14, 1994

[51] Int. Cl.[6] ..... B42D 15/00

[52] U.S. Cl. ..... 283/67; 283/56; 283/100; 283/111; 283/901

[58] Field of Search ..... 283/51, 56, 102, 100, 283/101, 105, 111, 903, 67, 901

[56] References Cited

U.S. PATENT DOCUMENTS

| | | | |
|---|---|---|---|
| 4,726,608 | 2/1988 | Walton | 283/903 X |
| 4,738,473 | 4/1988 | Meloni et al. | 283/903 |
| 5,000,486 | 3/1991 | Rua, Jr. et al. | 283/903 X |
| 5,002,313 | 3/1991 | Salvatore | 283/903 X |

*Primary Examiner*—Willmon Fridie
*Attorney, Agent, or Firm*—James Ray & Associates

[57] ABSTRACT

A paper card for providing a simulated fortune telling experience having a plurality of differing indicia printed thereon arranged in a defined pattern and having an opaque coating of material overlying the differing indicia sufficient to block the indicia from view without obstructing the defined pattern of arrangement of the indicia. The card further includes instructions printed thereon sufficient to instruct a reader regarding removal of the opaque coating from only certain portions within the defined pattern, to expose only the indicia in those limited areas, which the reader can interpret as he or she chooses for a simulated fortune telling experience.

5 Claims, 4 Drawing Sheets

FORTUNE TELLING CARD

FIELD OF THE INVENTION

This invention relates generally to fortune telling cards, and more particularly to a novel, low cost paper card one may purchased or otherwise acquire which can be utilized one time to expose certain printed words, phrases and/or symbols which can then be combined and interpreted as a basis for providing key words or clues for a simulated fortune telling experience.

BACKGROUND OF THE INVENTION

It is well known that certain persons thrive on efforts to foretell their futures; i.e., obtain some sort of forecast or clues with regard to events yet to occur in their lives in both a long-term and short term basis. Such efforts include such diverse activities as going to a fortune teller or a tea leaf reader, to reading one's daily, weekly or monthly horoscopes in their local newspaper. Normally, such fortune telling does not spell out the events to occur in detail, but merely provide clues or "visions" the recipient can interpret as he or she chooses. For example, a fortune teller may merely say: "I see a tall dark man in your future", which the recipient can interpret however he or she chooses to do so. If the recipient is a single woman hoping to soon marry, she may well interpret this as a prediction that she will marry a tall dark man. If the recipient is a man, on the other hand, he may assume this to be a reference to a future business associate, neighbor, friend or the like. Any given clue or "vision" can, therefore, be given to any recipient, regardless of the recipient's sex, age or interests, and the recipient will interpret the clue of "vision" to fit his or her own situation. In a like manner, horoscopes do not spell out details either, but normally merely advise the reader where his or her strengths and weaknesses will be during the period in question. For example, a horoscope may advise the reader that in his or her case, the period in question is not a good time to take particular actions, such as "you should avoid financial investments" or "avoid romantic involvement," etc. By providing only a few key words and/or phrases, the recipient is free to interpret the words and/or phrases as he or she chooses.

While many persons do tend to believe a fortune teller's predictions, having faith that words, phrases or "visions" foreseen will be shown to have some meaning in their future, others do not. In a like manner, some persons follow their horoscopes guidance while others do not. Even those who do not put any faith in a fortune teller's visions or horoscope's guidance, however, often times do indulge in such activities merely for the fun and enjoyment of doing so.

SUMMARY OF THE INVENTION

This invention is predicated upon a new and unique "scratch card" that can be utilized to provide the card holder with a novel, simulated fortune telling experience. By following the card's instructions, the card holder can expose a preselected number of random words, phrases and/or symbols which the card holder can interpret as he or she prefers, to thereby form a basis for a foretold future, or a basis for conducting ones activities in the future, or any other "vision" to which the card may be addressed. Whether or not the card holder puts any reliance in the foretold future, guidance or "vision", he or she will as a minimum, derive some enjoyment and entertainment from the effort, not only the activity of "scratching" the card to see what words, phrases and/or symbols he or she uncovers, but also in attempting to put the words, phrases and/or symbols into a meaningful arrangement.

In essence, the card is a simple, two-sided paper card having a plurality of differing indicia printed thereon. By "differing indicia" is meant different words, phrases and or symbols, which are preselected by the card maker. Such differing indicia is arranged on the card in a defined pattern, the defined pattern being one that should be readily apparent to the card holder. An opaque coating of material is provided over the plurality of words, phrases and/or symbols, i.e. indicia, so that the indicia can not be seen or read unless the opaque coating is scrapped, scratched or rubbed from the card's surface. The card should also be provided with instructions printed thereon instructing the card holder to select given number areas within the defined pattern from which he or she should remove the opaque coating to reveal such given number of words, phrases and/or symbols, and that the card holder should arrange those word, phrases and/or symbols to formulate a fortune telling prediction r other such "vision". Since the card holder himself or herself has selected the limited areas or spaces to be exposed, he or she will have basis to believe that the words, phrases and/or symbols exposed were those which were destined solely for him or for her. Indeed, different persons will select different areas or spaces to expose, and therefore, different persons will expose different indicia capable of entirely different interpretations. Thereafter, the card holder can enjoy the mental activity in trying to put the words, phrases and/or symbols together to formulate a meaningful prediction that will make sense, at least to the card holder.

OBJECTS OF THE INVENTION

The primary object of this invention is to provide a unique and novel, low cost fortune telling card capable of providing a simulated fortune telling experience.

Another primary object of this invention is to provide a novel, low cost fortune telling card capable of being utilized to derive a plurality of different words, phrases and/or symbols which one can utilize to formulate a simulated fortune telling experience or the like.

A further object of this invention is to provide a unique and novel, low cost fortune telling card one can utilize for the purpose of exposing certain indicia which one can combine for the purpose of interpreting his or her fortune as he or she chooses.

Still another object of this invention if to provide a novel, low cost fortune telling card one can utilize for the purpose of deriving a few minutes of fun and entertainment.

An additional object of this invention is to provide a novel, low cost fortune telling card which can be produced in large numbers and sold individually at points of display, such as counters were lottery tickets are sold, which will have appeal to certain persons for deriving a few minutes of fun and entertainment as well as a simulated fortune telling experience.

These and other objects and advantages of this invention will become apparent from a better understanding of the following detailed description of the invention.

DESCRIPTION OF THE PREFERRED EMBODIMENTS OF THE INVENTION

Figure 1:
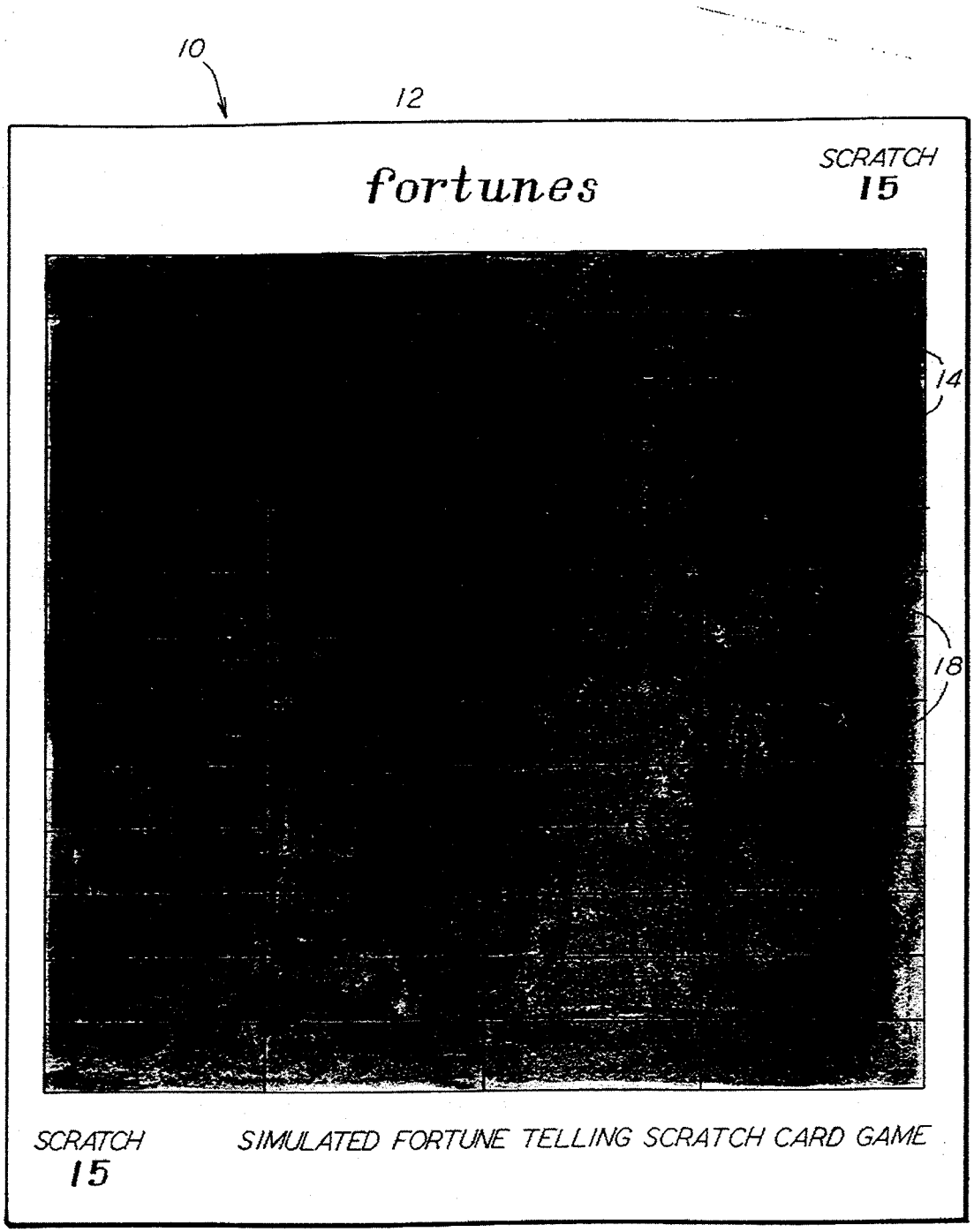
FIG. 1 is a face view of one embodiment of a fortune telling card according to this invention titled "Fortunes" which provides 52 spaces for indicia.

Prior to proceeding with a detailed description of the subject invention, it is noted that for the sake of clarity, identical components which have identical functions have been identified with identical reference numerals throughout the several views of the attached drawings.

Figure 2:
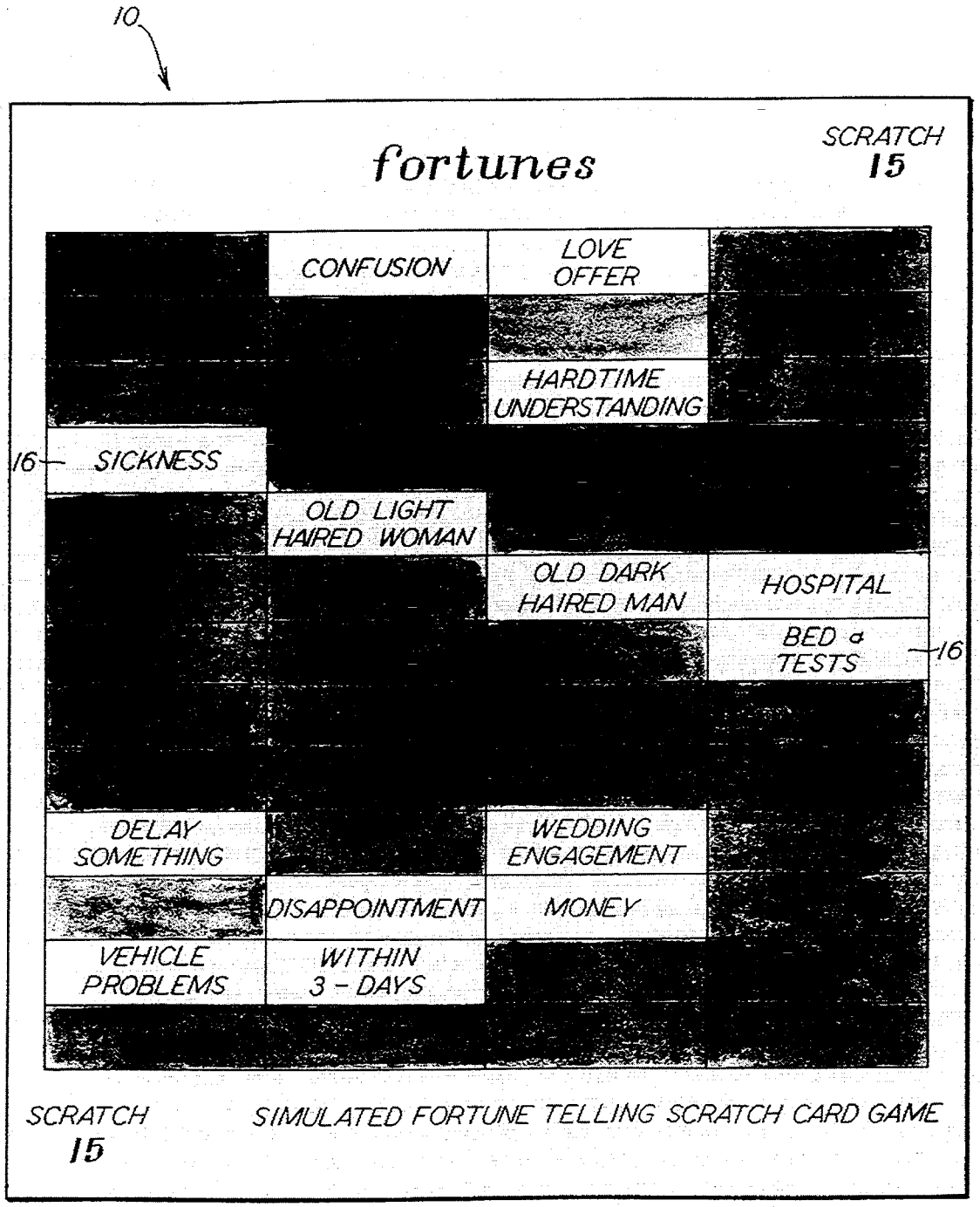
FIG. 2 is identical to FIG. 1 but illustrating the same fortune telling card after 15 areas have been scrapped to remove the opaque coating to expose 15 of the 52 words, phrases and or symbols.
Figure 3:
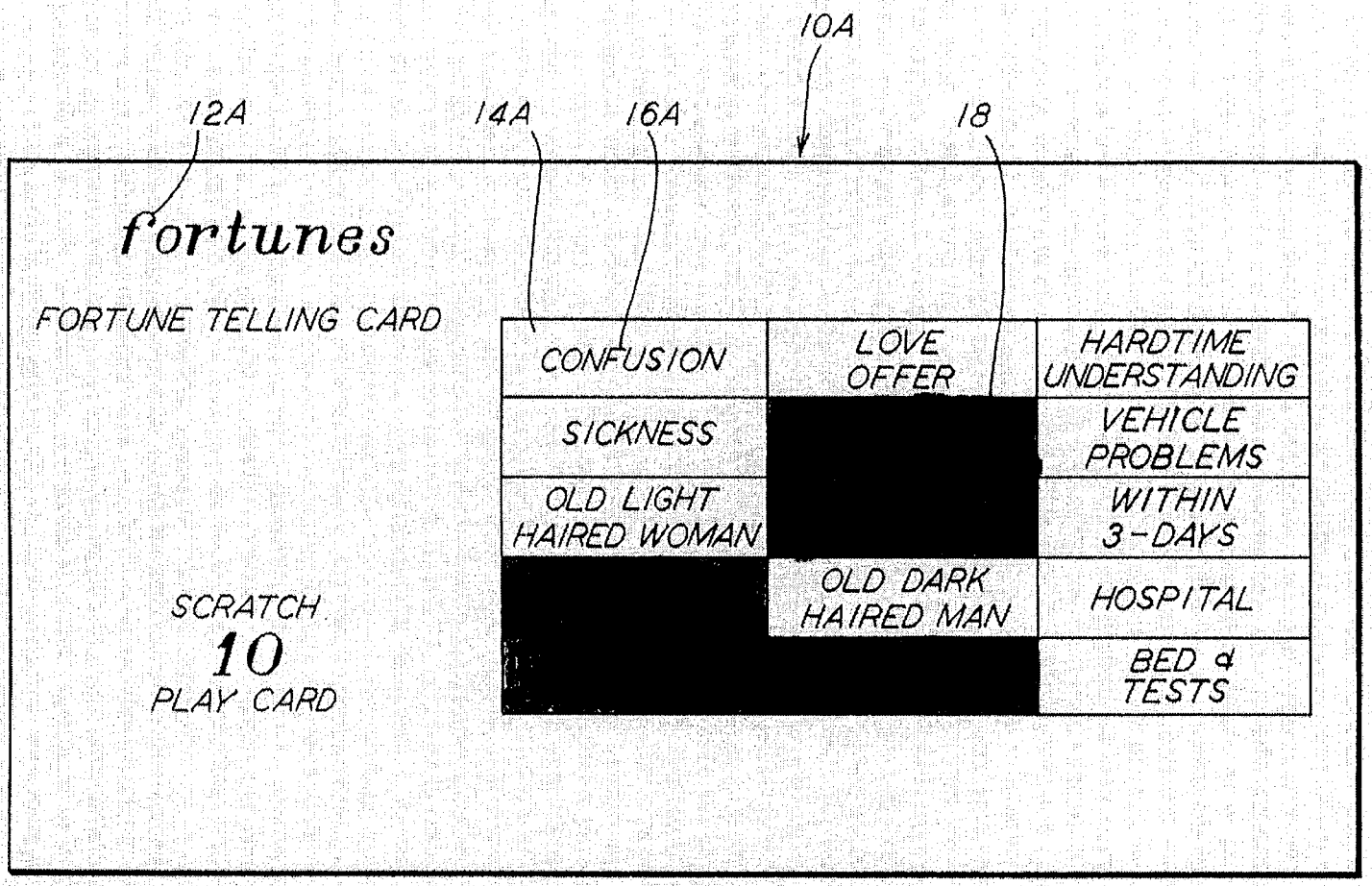
FIG. 3 is a view of the face side of another embodiment of a fortune telling card according to this invention, also titled "Fortunes" which provides 15 total spaces for indicia.
Figure 4:
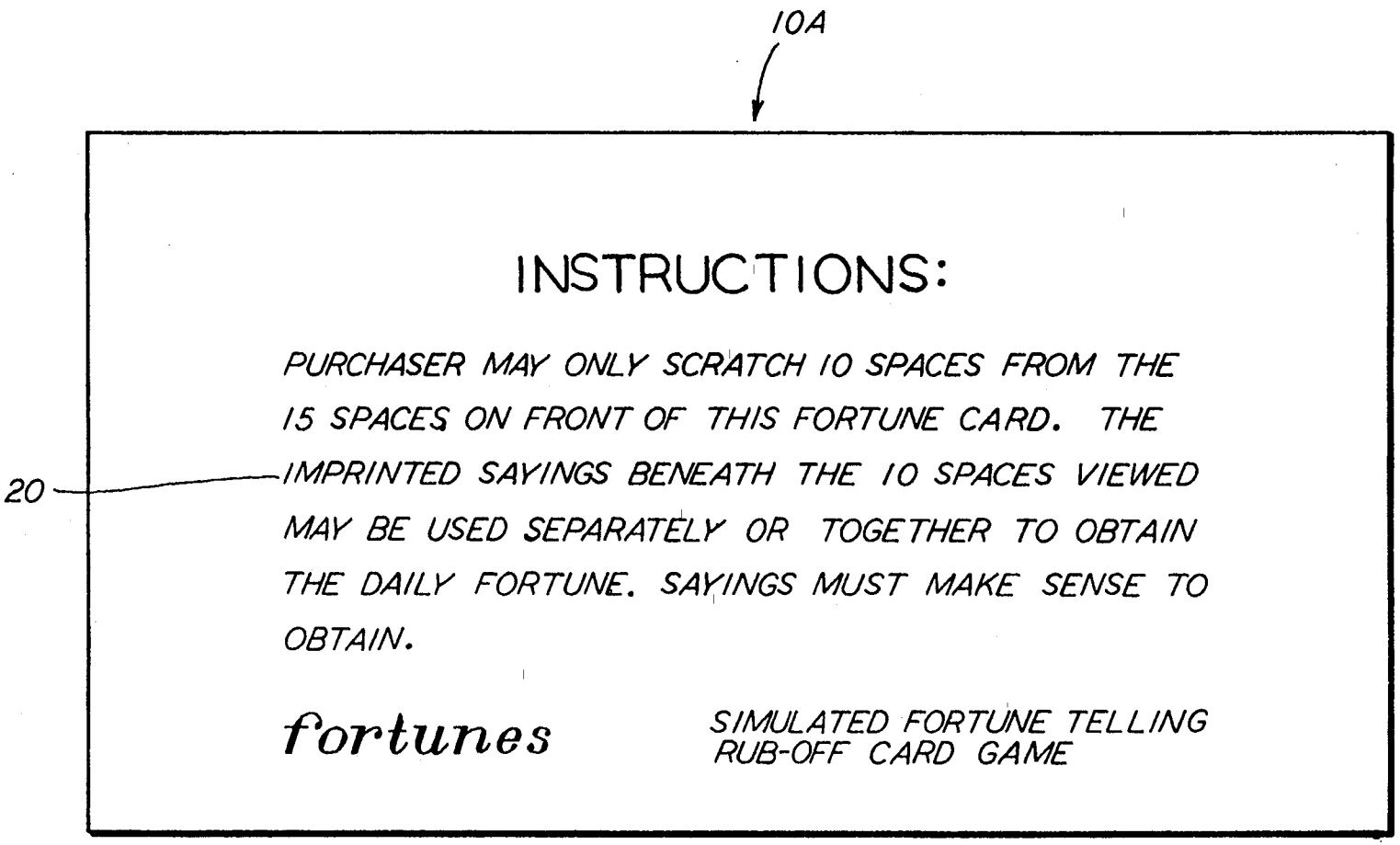
FIG. 4 is a view of the back side of the fortune telling card illustrated in FIG. 3 illustrating the instructions given to the reader.

Reference to FIGS. 1 and 2 will illustrate one embodiment of the unique fortune telling card of this invention, wherein the card generally designated 10, is a simple paper card of any desired dimension and thickness, but should be such that it is capable of mass production and easy handling, packaging and shipping, and at least one surface of which is a printed surface. One set of peripheral dimensions that are particularly preferred is a rectangular configuration measuring no more than about 3.5 inches wide and 5 inches high. While somewhat smaller dimensions would be easier to handle and lighter to ship, the 3.5 by 5 inch dimension noted above is ideal in order to provide an ample surface space sufficient to contain a good number of word, phrase and/or symbol printed thereon in a size that can readily be read. The embodiment illustrated in FIGS. 3 and 4, on the other hand, is a somewhat smaller card and measuring approximately 2 inches by 4 inches. As can be seen in FIGS. 3 and 4, this embodiment contains only 15 total spaces containing only 15 items of indicia, with the card holder instructed to expose only 10.

The at least one printed surface should preferably have some identifying printing 12 thereon such as "Fortunes—Scratch Card 15", as shown printed at the top of the card 10 in FIGS. 1 and 2. In addition to the identifying printing 12, a major portion of the at least one printed surface contains a plurality of differing individual spaces 14 with a different indicia 16 printed on each of the spaces 14, with the spaces 14 arranged in a readily apparent defined pattern. By indicia 16 is meant words, phrases and/or symbols which should be carefully selected by the card maker to be words, phrases and/or symbols that would be useful and typical in putting together a fortune telling sequence. As shown in FIGS. 1 and 2, the readily apparent defined pattern is a rectangular pattern having four columns with thirteen spaces in each column. One each of the differing indicia 16 is printed in each of the thirteen spaces 14 in each of the four columns, for a total of fifty-two spaces 14 with fifty-two differing indicia 16, in the FIGS. 1 and 2 embodiment. As can be seen from FIGS. 3 and 4, this embodiment, on the other hand, contains only fifteen total spaces 14A containing only fifteen items of indicia 16A, with the card holder instructed to expose only ten spaces 14A.

As shown in FIG. 1, an opaque coating of material 18 is provided sufficient to overlay the plurality of spaces 14, and in particular, cover the differing indicia 16 such that the indicia 16 cannot be seen or read with the coating of material 18 in place. The opaque coating of material 18, however, should be one that can be easily removed from the card 10 by scratching, scraping or rubbing the coating 18 to expose the indicia 16 printed thereunder. Such coatings 18 are commonly used on lottery tickets and the like, which can easily be scraped from the ticket's surface with an edge of a coin or the like, and are therefore, well known in the art. Accordingly, such opaque coating material 18 need not be further described here.

In addition to the above, instructions 20 (FIG. 4) should also be printed on card 10 which should be sufficient to instruct the reader regarding removal of the opaque coating 18 from only certain spaces 14 within said defined pattern of arrangement which the reader should select, to thereby expose only the indicia 16 in those limited spaces so chosen. In the embodiment shown in FIGS. 1 and 2, such instructions (not shown) would be printed on the back-side of the card (not illustrated), and it is intended that the card holder remove the coating material 18 from fifteen spaces 14 to thereby expose fifteen differing indicia 16, which will provide fifteen random indicia which can be interpreted as preferred by the card holder. If preferred, the instructions 20 can also provide instructions regarding how the indicia 16 should be arranged to derive the simulated fortune telling function. In it simplest form, such additional instructions may merely state that to constitute a proper simulated fortune, the indicia must be arranged in a manner that makes sense, at least to the card holder.

While the above-described fortune telling card of this invention could be produced and used in practically any manner one may choose, the primary intention is to produce such cards in great numbers, which can be sold to the public at any convenient outlet, such as counters where lottery tickets are sold, grocery or pharmacy check-out counters and practically anywhere else where the cards can be displayed for sale. Since such fortune telling cards are merely a novelty item intended to provide as a minimum a few minutes of fun and entertainment, obviously the cost thereof should be minimal, say for example one dollar per card. Obviously, once such a card is purchased, the purchaser can use it anyway he or she deem fit. In most situations, however, the purchaser will choose to follow the card's instruction in an effort to have his or her simulated fortune told, and thereby derive a few minutes of fun and entertainment whether or not any reliance is placed on the foretold fortune.

Having shown and described two embodiment of the invention above, it should be readily apparent that a great number variations could be made without departing from the spirit of the invention. In the embodiment illustrated in FIGS. 1 and 2, for example, it is suggested that the differing indicia 16 is printed only on the front side of the card 10, to derive fifty-two differing indicia 16. Obviously, a like pattern of spaces 14, each having an item of indicia 16 printed thereon, could be provided on the back side of card 10 (not shown) which would provide a total of one-hundred-four differing indicia 16. Obviously, while the total number of indicia 16 chosen and the placement thereof on the card 10 is a discretionary matter which the card producer will have to make, such a decision will be largely controlled by the size of the card 10, and the size of print deemed necessary to render an easily readable indicia 16 and the pattern of arrangement chosen.

While a rectangular pattern of arrangement is shown in the FIGS. 1 and 2 embodiment, obviously other patterns of arrangement could be utilized, such as individual and spaced apart spaces 14 or any other system one may choose. The important consideration here is that the card holder be able to distinguish between the individual spaces 14 before he or she start to remove the opaque coating 18 so that he or she will be able to readily choose the spaces 14 to be exposed. This can be done in a great number of differing ways, perhaps the simplest arrangement being by providing the spaces 14 as individual, spaced apart spaces, to thereby provide the opaque coating 18 also as a plurality of individual, spaced apart coatings, so that the individual spaces 14 and coating 18 thereover, can be easily, visually distinguished from the other, spaced-away, spaces 14 and coatings thereover. The one disadvantage to this approach, is that such spacing apart of the spaces 14 will result in wasted space which will restrict the total number of spaces 14 and indicia 16. As an alternative, the spaces 14 can be more closely arranged if they are separated by a line or grid of lines which is visible through a single, over-all coating 18. This can be done by providing a slightly raised grid of lines raised by the printing ink, or by providing an embossed grid of lines, either of which will visually separate the spaces 14. In the illustrated embodiments, spaces 14 are ideally separated by such a raised or embossed grid.

With regard to the indicia 16 chosen, there is of course a great latitude of variety that could be selected which is limited only by the card producer's imagination. While it is recognized that each indicia should be different from the rest, there may by certain words, phrases or symbols which the card producer my choose to include two of more times, particularly words, phrases and/or symbols which would have a more universal application to all potential card holders. This would render it more likely that such a more universal indicia would be uncovered, and even should the same indicia be uncovered two or more times, it could be interpreted as a rather important clue in a card holder's interpretation of his fortune. The columns below present just a few of the very many examples of indicia that could be utilized:

| | | |
|---|---|---|
| small trip | delay | flowers |
| confusion | surprise | airplane |
| love affair | dark haired man | wedding |
| small gift | dark haired woman | far away |
| hospital | good news | young man |
| large sum of money | doctor/lawyer | young woman |
| boy child | disappointment | vehicle |
| girl child | man in uniform | light colored |
| vehicle | argument | by the ocean |
| phone call | strong bond | mountains |
| letter(s) | small sum of money | bad health |
| difficulty | within 3 days | automobile |

In addition to words and phrases as exemplified above, commonly used symbols such as a heart, cupid, automobile profile, or practically any thing else that can be graphically depicted could be utilized whether noun of verb. Obviously, the above examples are intended merely to present but a few of the many thousands of indicia that could be utilized, and should in no way be considered as a limiting factor to the invention described.

In addition to the above rather broad latitude in applications of this invention, there are many others that could be utilized. For example, differing fortune telling cards could be produced which would be intended for differing classes of purchasers, such as some being tailored for men and others for women. In addition, still other embodiments could be addressed to providing a daily horoscope which would likely include some rather lengthy phrases. Still other embodiments could be specifically tailored to meet particular forecasting objectives by merely selecting more appropriate indicia 16, or even provide two or more separate areas of spaces 14 whereby indicia of differing nature are included in each. As an example, nouns could be placed in one group and verbs in another and the instructions then tailored to allow combining one or more indicia from one group with one or more indicia from one or more other groups. As another example, certain groups such as columns for example, could have topical headings such as "financial", "love life", "business", etc, which would then contain indicia within that group or column having meaning within such a topic. This then would provide the card buyer with a choice of topics he or she could pursue. In this case, obviously, the indicia chosen for each category would have to have particular meaning within that category. To be more in the nature of a horoscope, such topical headings could for example, include "strengths," weaknesses" and the like, with appropriate indicia included under such topics. Another possibility, would be to merely yield a plurality of random numbers suggested for play in the lottery.

In considering a regular program of selling such fortune telling cards through the same unchanging outlets, another variation would be that of changing the indicia 16 from time to time to provide new indicia or new indicia arrangements each week, or providing newer indicia from time to time to cause renewed interest when interest otherwise begins to wane. Indeed, changing the indicia from time to time, or at least its arrangement, would prevent a regular purchaser from memorizing the indicia and its arrangement which would cause a loss of interest.

In addition to the above inclusions, it is obvious that the fortune telling card of this invention could contain things which would make the card more interesting for entirely different reasons. For example, one or more additional scratch spaces could be provided for any one of a number of distinct and different purposes, such as, indicating whether the card holder has won a possible prize, such as a free card, or even a cash prize. Along these lines, the fortune telling card could provide a space for the card holder to write his name and address so that he or she could deposit his card for a future drawing for a prize. The possibility of winning a prize would certainly increase the sale of such fortune telling cards. Whether or not prizes could be awarded would depend upon state and local laws, so that the use of such an added feature will be dictated by such laws. If required by law, it may even be necessary that the card specifically provide "NO CASH AWARDS" or other such legal notice requirements.

In view of the above considerations, it is apparent that this invention should be appreciated for having a very wide scope of application, including not only those exemplified above, but many other obvious and not so obvious extension and variations thereof.

I claim:

1. A method of providing a simulated fortune telling experience to a card holder comprising:

a. providing such card holder with a card, said card having;

(i) a plurality of individual spaces thereon which are readily visible to such card holder;

(ii) an item of preselected fortune telling indicia printed on each said individual space; and (iii) an opaque coating of material overlying each of said items of fortune telling indicia, said opaque coating being sufficient to block said fortune telling indicia from view without obstructing said individual spaces, said opaque coating further being one that can be easily removed from said card to expose said fortune telling indicia printed thereunder;

b. instructing such card holder to select only a predetermined number of said spaces from which said coating is to be removed to thereby expose only a predetermined number of said fortune telling indicia;

c. instructing such card holder to examine the exposed fortune telling indicia and formulate a simulated fortune telling from such exposed fortune telling indicia.

2. A method of providing a simulated fortune telling experience to a card holder according to claim 1, in which said instructions provided in steps b. and c. are printed on said card.

3. A method of providing a simulated fortune telling experience to a card holder according to claim 1, in which said items of preselected fortune telling indicia are selected from the group consisting of words, phrases and symbols which have particular significance in fortune telling.

4. A method of producing a card that will provide a fortune telling experience to a holder of said card, the steps comprising:

a. providing a card having a plurality of readily visible individual spaces thereon;

b. printing an item of preselected fortune telling indicia on each of said individual spaces;

c. applying an opaque coating of material overlying each of said items of fortune telling indicia, said opaque coating being sufficient to block said fortune telling indicia from view without obstructing said individual spaces, said opaque coating further being one that can be easily removed from said card to expose said fortune telling indicia printed thereunder; and d. printing instructions on said card instructing such card holder to:

(i) remove said coating from only a predetermined number of said spaces to thereby expose only a predetermined number of said fortune telling indicia, and (ii) examine the exposed fortune telling indicia and formulate a simulated fortune telling from such exposed fortune telling indicia.

5. A method of producing a card that will provide a fortune telling experience to a holder of said card according to claim 4, in which said items of preselected fortune telling indicia are selected from the group consisting of words, phrases and symbols which have particular significance in fortune telling.

* * * * *

UNITED STATES PATENT AND TRADEMARK OFFICE

CERTIFICATE OF CORRECTION

PATENT NO. : 5,398,972

DATED : March 21, 1995

INVENTOR(S) : Frank S. Todaro

It is certified that error appears in the above-indentified patent and that said Letters Patent is hereby corrected as shown below:

Column 2, line 24, delete "word" and insert --words--;

column 2, line 25, delete "r" and insert --or--.

Column 3, line 38, delete "word" and insert --words--.

Column 5, line 66, delete "of" and insert --or--.

Column 6, line 31, after strengths, delete ","" and insert --", "--.

Signed and Sealed this

Twenty-third Day of April, 1996

*Attest:*

BRUCE LEHMAN

*Attesting Officer*

*Commissioner of Patents and Trademarks*